United States Patent [19]

Kipeläinen et al.

[11] Patent Number: 4,491,067

[45] Date of Patent: Jan. 1, 1985

[54] BARK PRESS

[75] Inventors: Ossi Kipeläinen; Antti Kuhasalo; Juhani Kyytsönen, all of Savonlinna, Finland

[73] Assignee: Enso-Gutzeit Oy, Helsinki, Finland

[21] Appl. No.: 380,022

[22] Filed: May 19, 1982

[30] Foreign Application Priority Data

May 22, 1981 [FI] Finland ..... 811578

[51] Int. Cl.[3] ..... B30B 3/04

[52] U.S. Cl. ..... 100/121; 100/157; 100/905

[58] Field of Search ..... 100/121, 157, 905, 907; 366/131, 134; 198/608, 657

[56] References Cited

U.S. PATENT DOCUMENTS 2,229,143 1/1941 Stacom ..... 100/157
3,652,020 3/1972 Kopps et al. ..... 198/608
3,882,023 5/1975 Wiegand, Sr. et al. ..... 100/121
4,026,206 5/1977 Cabrol ..... 100/117
4,355,573 10/1982 Berry ..... 100/121

*Primary Examiner*—Billy J. Wilhite
*Assistant Examiner*—Michael Knick
*Attorney, Agent, or Firm*—Toren, McGeady and Stanger

[57] ABSTRACT

A bark press including a frame and supporting rollers rotatably carried on the frame. These rollers support a rotatable dewatering drum, within which is eccentrically located a press roll, the outside surface of this press roll and the inner surface of the dewatering drum defining a press gap therebetween. The outside surface of the dewatering drum carries at least one ratchet circle with which at least one pressure cylinder cooperates. One end of this pressure cylinder is supported by the frame of the press and the opposite end rotating the dewatering drum step by step through the ratchet circle.

7 Claims, 2 Drawing Figures

BARK PRESS

Figure 1:
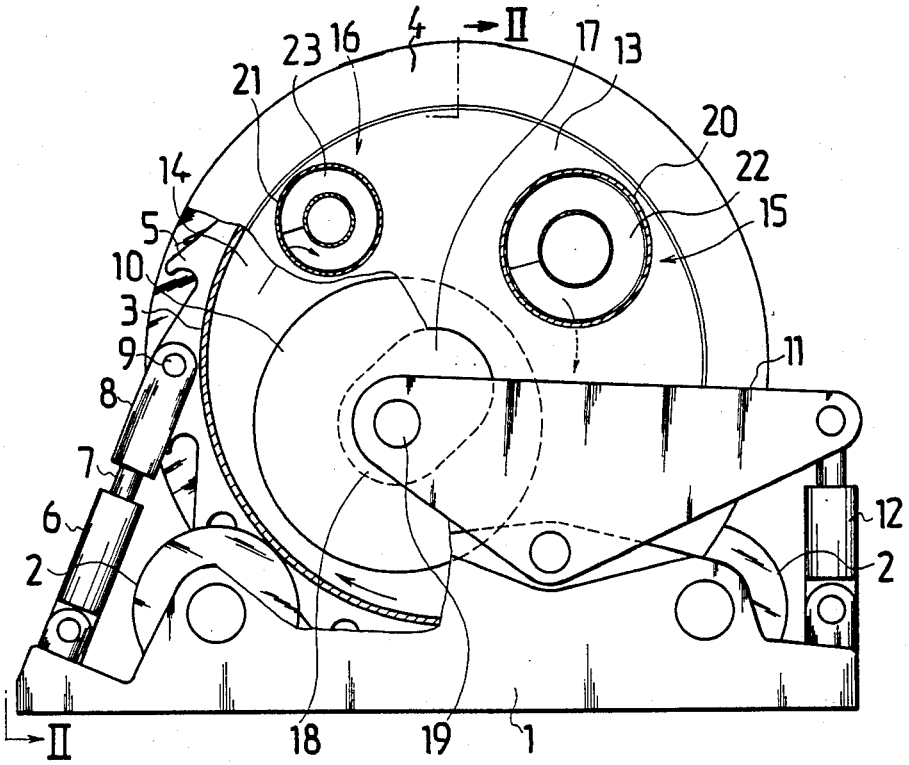

The present invention concerns a bark press comprising a frame and supporting rollers rotatably carried therein, supporting a rotatable dewatering drum within which is eccentrically located a press roll, the outer surface of this and the inner surface of the dewatering drum defining a press gap therebetween.

In the course of rising energy prices, more and more attention has been paid to improving the energy economy in the wood conversion industry. One of the significant targets is a better utilization of bark by burning. Prior to burning, endeavours have been made to remove as much water as possible so that the efficiency of the bark boiler might be high. Dewatering of the bark by mechanical pressing is an advantageous procedure. Therefore, the significance of the functioning of bark presses and of the dry matter content of the bark produced has increased.

It is known in the prior art to use bark presses in which compression is effected between two eccentrically displaced cylindrical surfaces. The outer surface is perforated so that water may run off. Presses like these function well, and using them it is possible to obtain dry matter content 40–55%, depending on bark type. The presses of the prior art are, however, encumbered by drawbacks that are associated with their drive means. The drive is usually an electric motor, rotating the dewatering drum through a gear transmission. Since the rotational speed of the dewatering drum is low, the gear transmission must be large. Therefore, the price of the drive means is high. In addition, the consumption of energy per ton of bark treated is great. The drive means is susceptible to trouble because it has to operate in conditions which are wet and most unclean. For the same reason, the wear of moving components takes place rapidly.

The object of the present invention is to provide a new type of bark press which is free of the drawbacks mentioned in the foregoing. The invention is characterized in that the dewatering drum carries on its outer surface at least one ratchet circle wherewith in cooperation is at least one pressure cylinder, one end of this pressure cylinder being carried on the frame of the press, and the opposite end rotating the dewatering drum step by step through the agency of the ratchet circle.

As to the initial cost, the bark press of the invention is inexpensive if compared to presses of the prior art. The energy consumption per ton of treated bark is a fraction of the energy consumption of presses of the prior art. The press of the invention is reliable in service. Virtually no disturbances may occur in its drive means.

The dewatering drum may have on its circumference one or more parallel ratchet circles. Accordingly, there may be one or more pressure cylinders. In any case, it is important that the ratchet circle or circles are located symmetrically so that no flexural forces act on the dewatering drum. In case there are more than one ratchet circle and pressure cylinder, the rotation of the drum can be made continuous by arranging the pressure cylinders to operate out of synchronism so that at any moment at least one pressure cylinder is pushing the drum in the direction of rotation. Nevertheless, it is to advantage if the press has no more than one ratchet circle and one pressure cylinder. In that case the movement of the drum is interrupted while the pressure cylinder is executing its return motion. During this time the water can drain from the bark bed in the press gap and pass through the perforated dewatering drum. The movement of the press cylinder in the direction in which it rotates the dewatering drum is considerably slower than its return movement.

The invention is described in the following with the aid of an example with reference to the attached drawing, wherein FIG. 1 presents the bark press according to an embodiment of the invention in end view and partly sectioned.

Figure 2:
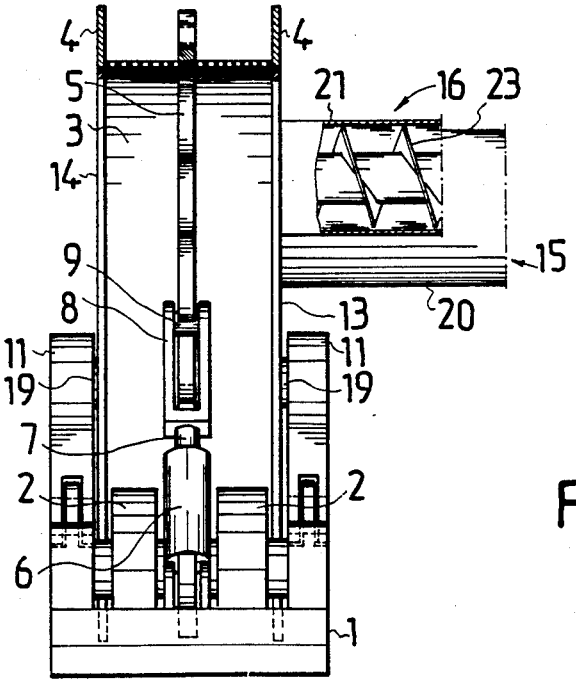

FIG. 2 presents the section along line II—II in FIG. 1.

In the drawing, the reference numeral 1 refers to the frame of the bark press, in which two support rollers 2 are rotatably carried. Upon these rests freely a dewatering drum 3 provided with a great number of water draining holes. The ends of the dewatering drum carry outwardly pointing bracing rings 4. On the circumference of the dewatering drum 3 has been affixed an encircling ratchet circle 5, located symmetrically with reference to the drum ends, as seen in FIG. 2. The ratchet circle 5 cooperates with a pressure cylinder 6, the lower end of which is carried by the frame 1 and to the free end of its piston rod 7 being affixed a fork 8. The fork 8 carries a transversal pin 9, which during the work stroke of the pressure cylinder engages with the teeth of the ratchet circle 5 one after the other.

Inside the dewatering drum 3 is eccentrically located a press roll 10. The shaft of the press roll is carried in one end of a beam 11 to be freely rotatable. The beam 11 is rotatably carried in the frame 1, and at its opposite end is located a pressure cylinder 12, the lower end of which is supported by the frame 1. Thereby, the beam 11 constitutes a two-armed lever. With the aid of the pressure cylinder 12, the pressure between the dewatering drum and the press roll 10 acting on the bark mat can be regulated. In addition, the pressure cylinder 12 permits spontaneous movements of the press gap.

The ends of the dewatering drum 3 are closed by means of stationary, circular plates 13 and 14, affixed to the frame 1. The plate 13 has an aperture for the bark feed conveyor 15 and another aperture for the bark exit conveyor 16. In addition, both plates have an aperture 17, 18 respectively, for the shaft 19 of the press roll 10. These apertures are elongated so that the shaft of the press roll may move.

The bark feed conveyor 15 and the exit conveyor 16 are screw conveyors. The conveyor tubes 20 and 21 terminate at the plate 13, but the conveyor screws 22 and 23 extend into the dewatering drum 3 up to the opposite plate 14.

The wet bark is introduced into the space confined by the dewatering drum and the plates 13 and 14 by means of the conveyor 15, wherefrom it falls into the press volume formed by the dewatering drum 3 and the press roll 10. The bark goes into the press gap where the highest pressing force prevails. The dewatering drum 3 is supported by one of the supporting rollers 2 at the very press gap. The water escapes through the dewatering drum 3, and the pressed bark ascends on the inside surface of the drum up to the exit conveyor 16. The press roll 10 rotates by effect of friction in synchronism with the dewatering drum 3. The pressure prevailing in the press gap is regulated with the aid of the pressure cylinder 12. The inside of the dewatering drum 3 may during the operation of the press contain greater or lesser quantities of bark. This is immaterial because the pressure cylinder 12 keeps the pressure constant in the press gap.

It is obvious to a person skilled in the art that various embodiments of the invention may vary within the scope of the claims stated below. For instance, the apertures for the bark feed conveyor and for the exit conveyor may equally be located on different sides of the dewatering drum, if space utilization so requires.

We claim:

1. Improvement in a bark press comprising a frame, a pair of support rollers disposed in spaced relation and rotatably mounted on said frame, a rotatable dewatering drum having an axis of rotation, an inside and an outside circumferential surface extending around the axis of rotation with the outside circumferential surface thereof supported on said pair of support rollers, said drum having a pair of spaced ends extending transversely of the axis of rotation and closing said drum, a press roll located within said dewatering drum eccentrically of the axis of rotation of said drum and the inside circumferential surface of said drum and and the outside surface of said press roll forming a press gap therebetween, a shaft for said press roll wherein the improvement comprises said press roll and said shaft for said press roll being freely rotatable, at least one ratchet circle is carried on and extends around the outside circumferential surface of said drum, at least one first pressure cylinder located exteriorly of said drum and having a first end and a second end with said first end supported on said frame and said second end disposed in engagement with said ratchet circle for rotating said detwatering drum in a step-by-step manner, said at least one first pressure cylinder is arranged to reciprocate so that its movement in one direction effects rotation of said dewatering drum and its movement in the other direction effects its return movement, and the movement in the one direction is slower than its movement in the other return direction, said at least one ratchet circle is symmetrically located on the outside circumferential surface of said dewatering drum between the ends of said drum, a beam is pivotally mounted on said frame about a pivot axis and is located on the exterior of said drum, said beam has a first arm extending from the pivot axis of the pivotal connection to said frame to said shaft of said press roll and a second arm extending in the opposite direction, a second pressure cylinder pivotally connected to the end of said second arm of said beam spaced from the pivot axis of the pivotal connection of said beam to said frame, and said second pressure cylinder arranged to pivot said beam about the pivot axis for positioning said press roll in spaced relation relative to the inside circumferential surface of said dewatering drum for selectively varying the press gap between said press roll and the inside circumferential surface of said drum.

2. Bark press according to claim 1, wherein a stationary plate is located within each of the opposite ends of said dewatering drum for closing off the interior of said dewatering drum, at least one of said stationary plates having apertures therethrough, a bark feed conveyor connected to one of said apertures, a bark exit conveyor connected to another one of said apertures, and said shaft for said press roll extending through a third one of said apertures and said third one of said apertures being elongated to afford movement of said shaft and said press roll relative to the inside circumferential surface of said drum.

3. Bark press according to claim 2, wherein said apertures for said bark feed conveyor and bark exit conveyor are located in said stationary plate at one end of said dewatering drum.

4. Bark press according to claim 2, wherein said apertures for said bark feed conveyor and said aperture for said bark exit conveyor are located at the opposite ends of said dewatering drum.

5. Bark press according to claim 2, wherein said bark feed conveyor and bark exit conveyor are screw conveyors.

6. Bark press according to claim 2, wherein said bark feed conveyor and said bark exit conveyor extend into said dewatering drum inwardly from said stationary plates located at the ends of said dewatering drum.

7. Bark press according to claim 1, wherein one of said support rollers is located in contact with the outside circumferential surface of said dewatering drum directly opposite the passages between said press roll and said inside circumferential surface of said dewatering drum.

* * * * *